US008167742B1

(12) United States Patent
McNee

(10) Patent No.: US 8,167,742 B1
(45) Date of Patent: May 1, 2012

(54) TRAINING STRAP FOR IMPROVING A GOLFER'S GOLF STROKE

(76) Inventor: Bruce McNee, Peoria, AZ (US)

( * ) Notice: Subject to any disclaimer, the term of this patent is extended or adjusted under 35 U.S.C. 154(b) by 0 days.

(21) Appl. No.: 12/959,300

(22) Filed: Dec. 2, 2010

Related U.S. Application Data

(60) Provisional application No. 61/390,551, filed on Oct. 6, 2010.

(51) Int. Cl.
*A63B 69/36* (2006.01)

(52) U.S. Cl. ..... 473/409; 473/212

(58) Field of Classification Search ..... 473/201, 473/205, 206, 207, 208, 212, 215, 216, 226, 473/227, 229, 409, 461
See application file for complete search history.

(56) References Cited

U.S. PATENT DOCUMENTS

| | | | | |
|---|---|---|---|---|
| 475,432 | A | 5/1892 | Blades | |
| 2,093,153 | A | 7/1935 | McCarthy | |
| 2,022,910 | A | 12/1935 | Hanley | |
| 2,806,267 | A | 4/1955 | Heaton | |
| 3,101,196 | A * | 8/1963 | Ferrara | 473/63 |
| 3,637,219 | A | 1/1972 | Lemon | |
| 3,679,214 | A * | 7/1972 | Boyte | 473/212 |
| 3,740,052 | A | 6/1973 | Arkin | |
| 4,582,325 | A | 4/1986 | Yuhara | |
| 4,662,640 | A | 5/1987 | Grander | |
| 4,895,373 | A | 1/1990 | Richmon | |
| 4,940,237 | A | 7/1990 | Mortensen | |
| 5,149,099 | A * | 9/1992 | Radakovich | 473/208 |
| 5,174,575 | A | 12/1992 | Leith et al. | |
| 5,203,570 | A | 4/1993 | Graham | |
| 5,451,060 | A | 9/1995 | Dalbo | |
| 5,665,015 | A * | 9/1997 | Clark, III | 473/409 |
| 5,795,238 | A | 8/1998 | Nicholson | |
| 5,893,803 | A * | 4/1999 | Leadbetter et al. | 473/206 |
| 7,083,528 | B2 | 8/2006 | Marland et al. | |
| 2002/0039930 | A1 | 4/2002 | Smith | |

* cited by examiner

*Primary Examiner* — Nini Legesse
(74) *Attorney, Agent, or Firm* — Morgan Law Offices, PLC

(57) ABSTRACT

A training strap for improving a golfer's golf stroke is provided. The training strap includes a shoulder strap that attaches around the lead shoulder of the golfer with the opposite end attaching around the golfer's thumb on the same lead side of the body. Preferably, the training strap includes a strap length adjuster allowing the training strap to be fitted to the proper length. The golfer practices the stroke with the criterion being to keep the training strap taut. If the training strap stays taut, the user will develop a very fundamentally sound, repeatable stroke. When this is done the golfer is successfully utilizing the radius from the lead shoulder to hands to bottom out at the correct spot, thereby creating a good chipping, pitching or putting stroke.

2 Claims, 3 Drawing Sheets

TRAINING STRAP FOR IMPROVING A GOLFER'S GOLF STROKE

CROSS-REFERENCE TO RELATED APPLICATIONS

The present application is related to and claims priority from prior provisional application Ser. No. 61/390,551 filed Oct. 6, 2010, the contents of which are incorporated herein by reference.

FIELD OF THE INVENTION

The present invention relates to the field of golf training equipment, and, more particularly, to a training device to be used by a golfer to develop proper motion for pitching, chipping and putting.

BACKGROUND

The basic act of swinging a golf club involves developing a method of delivering the club head to the ball in such a fashion that the club head bottoms out at a precise point during the downswing. Pitching, chipping and putting involve precise directional and distance expectations that are very hard to develop if the club is not swung in a manner that provides crisp, consistent contact. While modern equipment has provided a great deal of improvement for most people on longer shots, the short, precise shots are still very difficult for many golfers.

SUMMARY OF THE INVENTION

According to a preferred embodiment of the present invention, a training strap for improving a golfer's stroke comprises a shoulder strap including a first strap portion, the first strap portion including a first loop formed by folding over an end portion of the first strap portion onto itself and attaching the folded over end portion to the first strap portion; and a second strap portion, the second strap portion forming a second loop and passing through the first loop; and a club-end strap including a third strap portion, the third strap portion including a third loop at an end portion of the third strap portion. Preferably, the training strap further includes a strap length adjuster, the strap length adjuster situate between the shoulder strap and the club-end strap. Preferably the strap length adjuster is a cam buckle that allows the length of the strap to be adjusted.

Preferably, the first strap portion and the second strap portion forming the shoulder strap are a continuous strip of material. Preferably, the strap length adjuster joins the shoulder strap and the club-end strap, the club-end strap being a separate strip of material. Preferably, the material used to construct the training strap is a durable cloth material, most preferably, polypropylene.

In use, the training strap attaches around the lead shoulder of the golfer with the opposite end attaching around the golfer's thumb on the same lead side of the body. The golfer practices the stroke with the criterion being to keep the training strap taut. If the training strap stays taut, the user will develop a very fundamentally sound, repeatable stroke.

These and other aspects, features, and advantages of the present invention will become apparent from the following detailed description of preferred embodiments, which is to be read in connection with the accompanying drawings.

DETAILED DESCRIPTION

Figure 1:
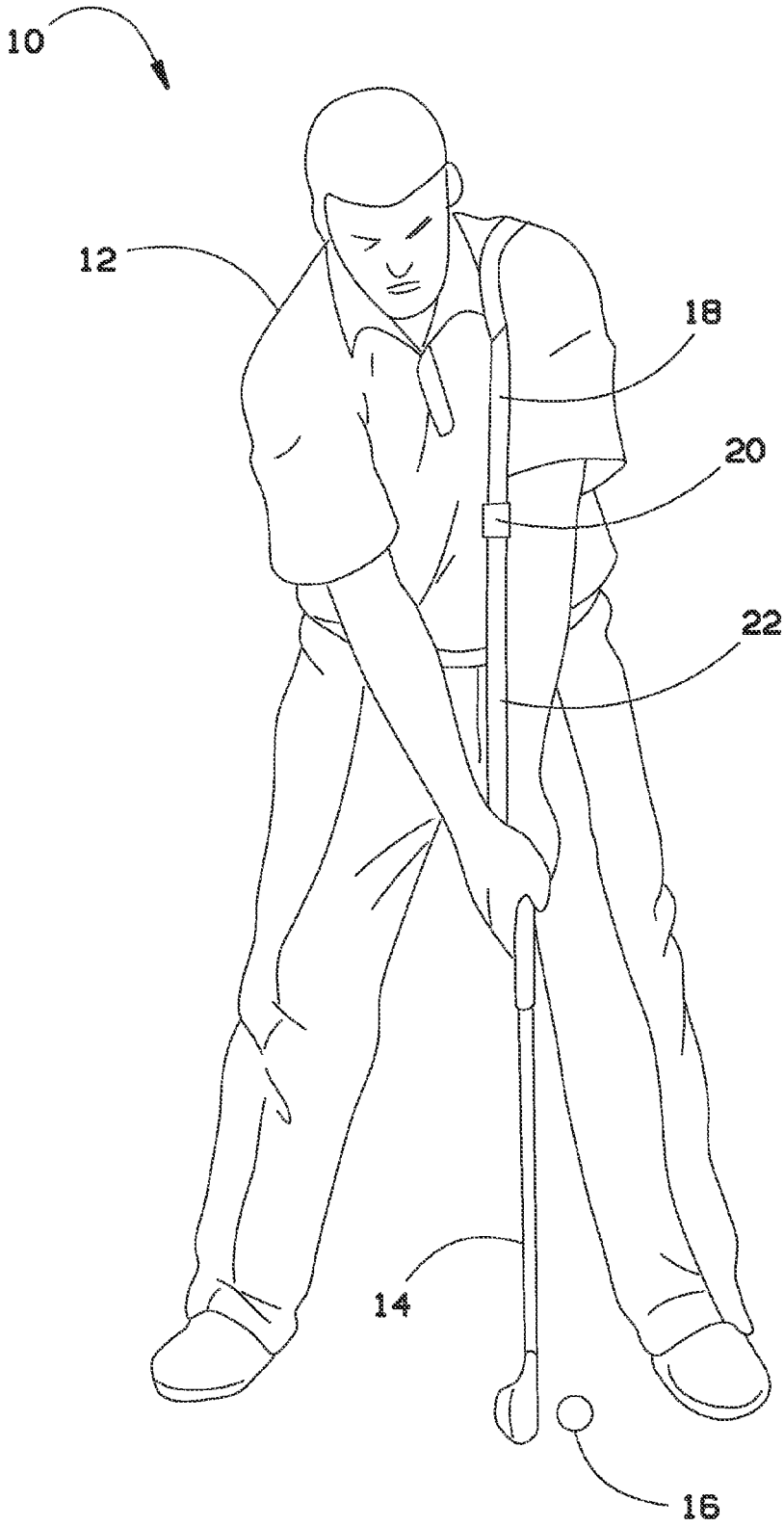
FIG. 1 shows an exemplary training strap being used by a golfer, according to a preferred embodiment of the invention.

FIG. 1 illustrates an exemplary training strap 10 being used by a golfer 12, according to a preferred embodiment of the invention. As depicted, the training strap 10 includes a shoulder strap 18 that attaches around the lead shoulder of the golfer 12, a club-end strap 22 that attaches around the golfer's thumb (or hand or finger) on the same side of the body, and strap length adjuster 20 situate between the shoulder strap 18 and the club-end strap 22 allowing the training strap to be fitted to the proper length.

Figure 2:
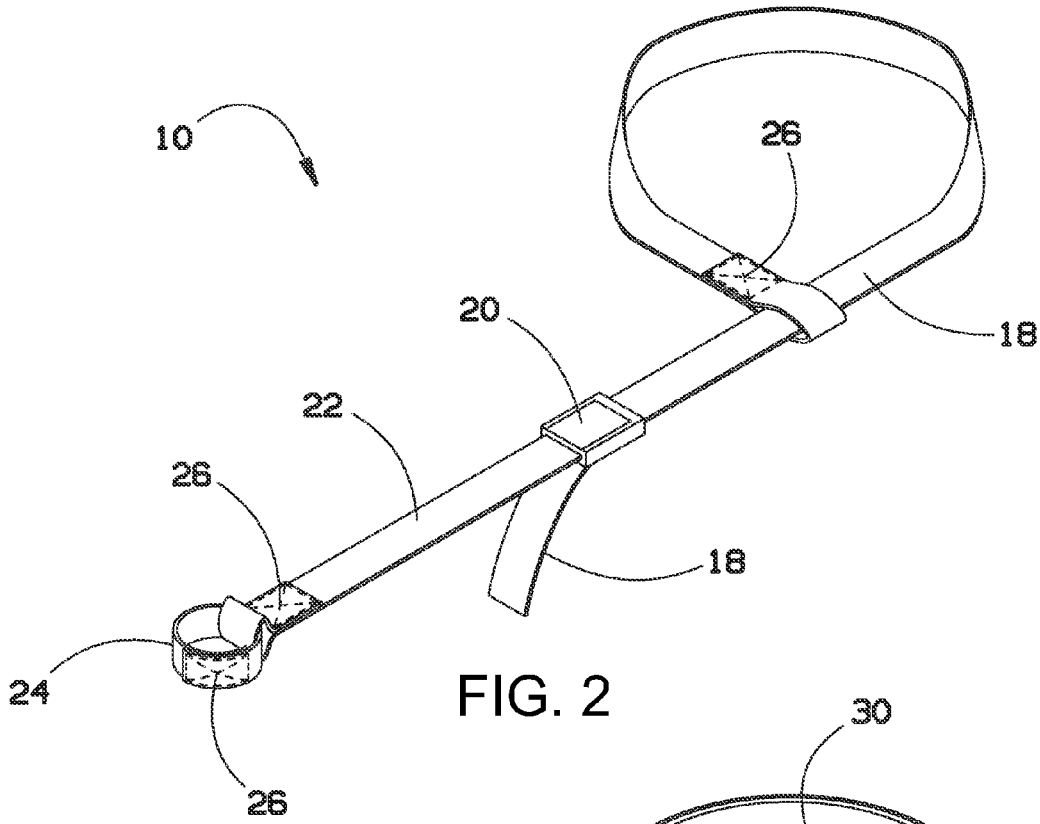
FIG. 2 shows a perspective view of the training strap of FIG. 1.

Referring to FIG. 2, a perspective view of the training strap 10 is shown. As shown in FIG. 2, the shoulder strap 18 includes a first loop formed by folding over an end portion of the first strap portion onto itself and attaching the folded over end portion to the first strap portion; and a second strap portion, the second strap portion forming a second loop and passing through the first loop. The club-end strap 22 includes a third strap portion, the third strap portion including a third loop (thumb loop 24) at an end portion of the third strap portion. Preferably, the first loop and the third loop are attached by stitching 26, though other ways to fasten the material together, such as gluing, may suffice.

To use the invention, the golfer 12 puts the shoulder strap 18 around the lead shoulder and pulls it tight. Then, the golfer 12 puts his or her thumb (or lead hand finger, or fingers) in the thumb loop 24. In operation, the training strap 10 provides positive feedback regarding the proper feel of maintaining the radius from the lead shoulder to the hands of the golfer 12 while gripping and swinging the golf club 14 toward a golf ball 16. In particular, when the training strap 10 is taut, the golfer 12 will feel the stroke via the lead shoulder pulling the shoulder strap 18 to keep the tautness through the hit. The golfer 12 practices the stroke with the criterion being to keep the training strap 10 taut. If the training strap 10 stays taut, the user will develop a very fundamentally sound, repeatable stroke. When this is done the golfer 12 is successfully utilizing the radius from the lead shoulder to hands to bottom out at the correct spot, thereby creating a good chipping, pitching or putting stroke.

Figure 3:
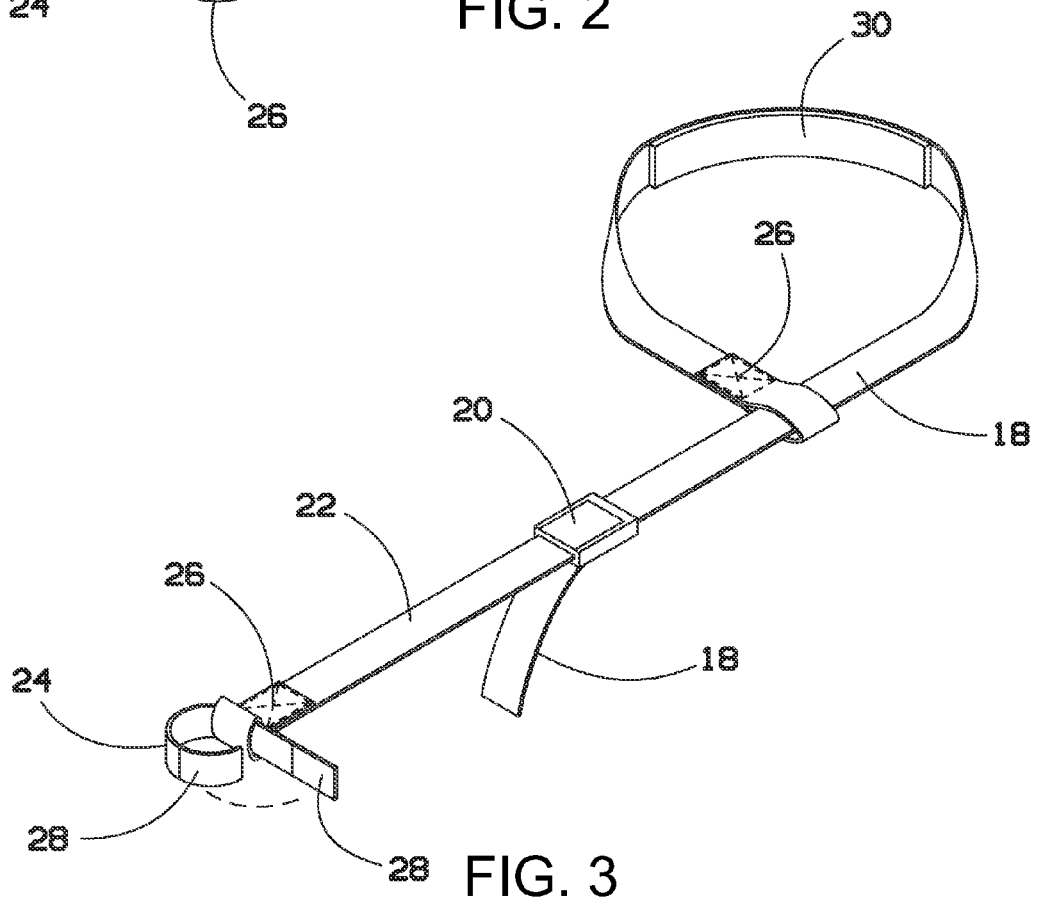
FIG. 3 shows an exemplary training strap with an optional shoulder pad, according to an alternate preferred embodiment of the invention.

Referring to FIG. 3, the training strap 10 is shown with optional shoulder pad 30. Preferably, the shoulder pad 30 is made of a soft, padded material. Preferably, the shoulder pad 30 is formed using a separate piece of material sewn or glued into the shoulder strap 18. Also, as shown in FIG. 3, the thumb loop 24, preferably, includes a hook-and-loop fastener 28, such as VELCRO, to allow for easy operation. Alternatively, the thumb loop 24 could be constructed as a continuous loop of fabric.

Figure 4:
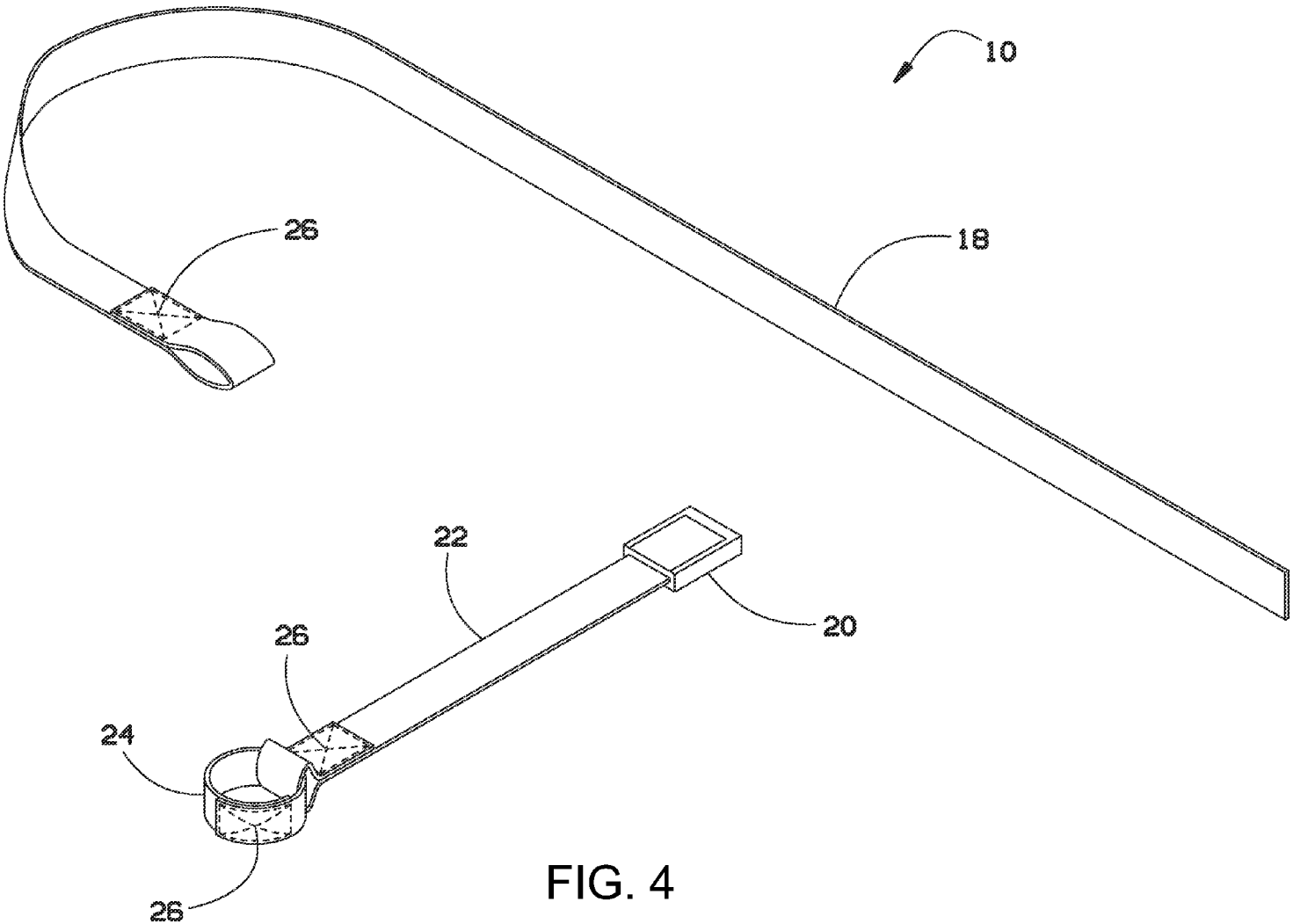
FIG. 4 shows the exemplary training strap of FIG. 1 disassembled into component parts.

FIG. 4 shows the exemplary training strap of FIG. 1 disassembled into component parts. In particular, the shoulder strap 18 and the club-end strap 22 are preferably two pieces of material that are joined together by the strap length adjuster 20. Preferably, the shoulder strap 18 and the club-end strap 22 are about 1 inch in width. Preferably, the shoulder strap 18 is from about 30 to 45 inches long. Preferably, the first loop extends about 3 or 4 inches to a stitched fold 26. Preferably, the club-end strap 22 is about 10 to 14 inches long, and the thumb loop 24 is about 5 to 6 inches long and about ¾ inches in width. Preferably, the strap length adjuster 20 is a cam buckle. Preferably, the material used for the shoulder strap 18 and the club-end strap 22 will include a durable cloth material, such as polypropylene, nylon, polyester, cotton, or a blend thereof.

While the training strap 10 is shown (in FIG. 1) being used by a right-handed golfer 12, it is to be understood that the present invention may be also used by a left-handed golfer. To use the training strap, it is necessary to slip the shoulder strap 18 over the golfer's lead shoulder while the lead thumb (or lead hand finger, or fingers) is placed through the thumb loop 24. The lead shoulder/arm/hand is on the left side for a right-handed golfer and the right side for a left-handed golfer.

While this invention has been described in conjunction with the various exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A method for using a training strap to improve a golfer's golf stroke, comprising the steps of:

providing the training strap, the training strap comprising:

a shoulder strap including, a first strap portion, the first strap portion including a first loop formed by folding over an end portion of the first strap portion onto itself and attaching the folded over end portion to the first strap portion;

a second strap portion, the second strap portion forming a second loop and passing through the first loop; and a club-end strap including, a third strap portion, the third strap portion including a third loop at an end portion of the third strap portion; using the training strap, attaching the second loop around the golfer's lead shoulder and pulling the second strap portion further through the first loop until the second loop fits snugly;

attaching the third loop around a thumb of the golfer, the thumb and the lead shoulder being on the same side of the golfer's body; and adjusting the length of the training strap such that the training strap is taut when the golfer is standing in an upright position.

2. The method of claim 1, further comprising the step of swinging a golf club with the training strap attached, whereby the training strap provides positive feedback regarding the proper feel of maintaining the radius from the lead shoulder to the golfer's hands while gripping and swinging the golf club.

* * * * *